United States Patent [19]

Donofrio

[11] 3,953,621

[45] Apr. 27, 1976

[54] PROCESS OF FORMING CATHODE RAY TUBE SCREENS

[75] Inventor: Robert L. Donofrio, Elbridge, N.Y.

[73] Assignee: GTE Sylvania Incorporated, Stamford, Conn.

[22] Filed: Mar. 21, 1974

[21] Appl. No.: 453,437

[52] U.S. Cl. ..... 427/54; 96/36.1; 427/68

[51] Int. Cl.[2] ..... B05D 3/06; H01J 31/20

[58] Field of Search ..... 96/36.1; 117/33.5 C, 117/33.5 CM; 427/54, 68

[56] References Cited

UNITED STATES PATENTS

| | | | |
|---|---|---|---|
| 3,144,331 | 8/1964 | Thommes | 96/87 R |
| 3,186,844 | 6/1965 | Alles et al. | 96/87 R |
| 3,287,130 | 11/1966 | Kaplan | 96/36.1 |
| 3,330,682 | 7/1967 | Tamura | 117/33.5 CM |
| 3,365,292 | 1/1968 | Fiore et al. | 117/33.5 LM |
| 3,661,580 | 5/1972 | Mayaud | 96/36.1 |
| 3,708,336 | 1/1973 | Nishizawa et al. | 117/33.5 C |
| 3,853,560 | 12/1974 | Ohgoshi | 117/33.5 C |

*Primary Examiner*—John H. Newsome
*Attorney, Agent, or Firm*—Norman J. O'Malley; Frederick H. Rinn; Cyril A. Krenzer

[57] ABSTRACT

An improved process is provided for forming at least one set of elements of a patterned CRT screen disposed in overlay relationship upon an opaquely defined windowed-webbing priorly applied to the interior surface of the tube viewing panel in accordance with an apertured mask. The invention concerns the placement of a reflective medium over the exterior surface cf the panel during screen exposure. By this means the exposure radiation traversing the screen and panel is reflected back through the respective windows in the screen structure to augment the polymerization and adherence of the pattern elements.

8 Claims, 6 Drawing Figures

PROCESS OF FORMING CATHODE RAY TUBE SCREENS

BACKGROUND OF THE INVENTION

This invention relates to color cathode ray tubes and more particularly to an improvement in the process of forming a patterned cathodoluminescent screen on the viewing area of a cathode ray tube face panel.

Cathode ray tubes, of the types utilized to present color display imagery for television and allied applications, usually employ patterned multi-element screen structures comprised of repetitive groupings of related cathodoluminescent color-emitting phosphor materials. As practiced in conventional tube construction, a discretely apertured pattern member is usually positioned in spaced relationship with the patterned screen. In a post deflection type of tube, this apertured member functions as an electrode in the finished tube, and is commonly utilized in the prior deposition of the patterned elements of the cathodoluminescent screen on the interior surface of the glass viewing panel portion of the tube envelope. In the common shadow mask type of tube construction, the multi-element screen pattern is similarly formed by using a spacially positioned apertured pattern member. In both types of tubes, each of the openings or apertures in the pattern member, being of a substantially round, ovate, elongated, or rectangular shaping, is related to a specific grouping of similarly shaped related color-emitting phosphor elements spaced therefrom in a manner to enable selected individual electron beams to traverse the common aperture and impinge the proper pattern elements therebeyond. Normally the individual phosphor elements of the screen pattern are separated from one another by relatively small interstitial spacings which tend to enhance color purity of the imagery by reducing the possibility of adjacent color-emitting elements being energized by a specific electron beam.

It has been found that contrast in color screen imagery can be improved by filling in the interstitial spacings between the respective phosphor elements with an opaque light-absorbing material. Primarily, the inclusion of this fill-in material enhances contrast by preventing ambient light from being reflected by the unexcited areas of the screen and the aluminum backing on the screen in the interstitial areas not covered by phosphor elements. Thus, by incorporating such material into the screen structure, each phosphor element, as seen by the viewer, is defined by a substantially nontranslucent encompassment which collectively comprise a multi-opening pattern in the form of a windowed-webbing having a lace-like array of opaque interconnecting interstices. Such web-like screen structures have been fabricated, either before or after phosphor screening by several known processes wherein photodeposition techniques constitute a fundamental part.

Usually each phosphor area of the color screen pattern and the electron beam impingement thereon are of areas larger than that of the associated window in the opaque webbing. Thus, there is "extra" phosphor material and extra electron excitation energy that is masked from the viewer and/or absorbed by the opaque webbing at each phosphor site. Thus, the definitive windows in the opaque webbing, while beneficially improving contrast and color purity, tend to reduce luminescent brightness by blocking out and absorbing the peripheral luminance of the formed phosphor areas. This is particularly noticeable in those screen pattern elements which are constituted of phosphor materials that are least bright in luminescence and color emission.

A variety of methods have been employed to form the patterned screen structures for color cathode ray tubes having defined color-emitting window areas; for example, one conventional process makes use of a repetitive photoprinting technique. For this procedure, the tube viewing panel, having the opaque windowed-webbing priorly formed thereon, is coated with a thin film of a negative photosensitive binder substance, such as sensitized polyvinyl alcohol, and a specific color-emitting phosphor material. This coating application is achieveable by several techniques, for example, one process involves the application of a coating film of the photosensitive substance upon which phosphor powder is disposed, while by another procedure, the screening material is applied as a suspension of phosphor in a photosensitive substance. Regardless of how the phosphor is applied, the coated panel is then discretely exposed to radiant energy, in substantially the ultraviolet range, to cause the negative photosensitive substance to light polymerize and adhere to the interior surface of the panel thus binding the phosphor particles therewith. Prior to exposure, the apertured mask member is temporarily positioned within the panel in spaced adjacency to the sensitized coating, whereupon the mated mask-panel assembly is suitably oriented on an exposure apparatus. This apparatus includes means for predeterminately positioning an optical system wherefrom exposure light is radiated and directed through the mask apertures. Discrete areas of the photosensitive film, thusly exposed to the radiant energy, become polymerized or hardened thereby adhering to the surface of the glass panel forming an imprint of a first screen pattern of phosphor elements in the appropriate window areas. The exposed screen pattern is then subjected to a developing step which removes the intervening unexposed portions of the photosensitive film that were shadowed by the solid portions of the mask member during exposure. The above described procedure is twice repeated in a related manner to dispose the required associated color-emitting phosphor elements to complete the patterned screen combination. For the separate exposure of each portion of the screen pattern, the light source and associated optical system are properly positioned to effect deposition of the respective color-emitting components in the proper window areas.

In U.S. Pat. No. 3,697,301, issued to R. L. Donofrio et al. and assigned to the assignee of the present invention, there is disclosure that the inherent brightness efficiencies of the phosphor materials comprising the screen of the cathode ray tube can be utilized by optimizing the thickness of the phosphor elements comprising the screen pattern. Because of the differences in the light attenuating characteristics of the various phosphor materials that are utilized in patterned screen construction, it has been found difficult to adequately achieve efficient photodeposition of patterned elements that are optimized both in thickness and areal dimension. For example, the light attenuation characteristics of some phosphor materials are such that relatively lengthy exposure times are required to effect the degree of polymerization necessary to securely adhere the pattern element to the surface of the panel. In some instances, excessive exposure promotes undesirable lateral or areal polymerization beyond the bounds normally desired to insure good color-purity operation. Thus, in achieving the desired adherence, and the controlled areal polymerized "growth" of the pattern element, the optimum screen weight or thickness becomes a factor sometimes relegated to a secondary degree of importance. An attempt to overcome this type of difficulty has been manifest in the utilization of additional exposure radiation emanating from a front oriented light source projected through the panel in conjunction with the normal exposure radiation directed through the aperture mask. Simultaneous usage of two light sources presents problems for adjusting proper exposure from both units and increases inherent maintenance problems.

OBJECTS AND SUMMARY OF THE INVENTION

It is an object of the invention to reduce the aforementioned disadvantages by providing an improvement in the process of forming a patterned cathodoluminescent screen on the viewing area of a color cathode ray tube face panel, whereof the screen is in overlay relationship to an opaquely defined windowed webbing priorly disposed thereon.

It is another object of the invention to provide an improvement in the process for forming a patterned cathode ray tube screen wherein the rate of polymerization of the pattern elements is accelerated.

It is a further object of the invention to provide an improved color screen forming process that promotes improved achievement of the optimum screen weights for the respective phosphor materials.

These and other objects and advantages are achieved in one aspect of the invention that marks an improvement in the process of forming at least one set of pattern elements comprising the patterned screen of a color cathode ray tube which is disposed in overlay relationship to an opaquely defined windowed-webbing priorly disposed on the face panel. A coating of an energy sensitive and a related phosphor material are disposed over the windowed-webbing of the panel, whereupon an apertured mask is spatially positioned within the panel. The mask-and-panel assembly is then positioned on a screen exposure apparatus which accommodates a source of exposure energy determinately oriented therein. Before exposure is consummated, a mirror surface or reflective medium is placed relative to the exterior surface of the panel, such medium being of a shaping compatible with the exterior contour of the panel. In effecting exposure, radiant energy is beamed through the apertured mask to initiate primary-ray polymerization of discrete coating areas superimposed on the defined window areas of the webbing. Simultaneously, a portion of this primary radiation traverses the phosphor, associated coating, and the panel therebeneath thereby impinging the reflective medium to produce reflected secondary radiation which retraverses the panel and effects augmented secondary-ray polymerization and improved adherence of substantially the obverse region of the interfacially related coating in the window areas. Thus, with a decrease in exposure time, the improvement of adherence resultant from the reflected secondary radiation fosters optimization of screen pattern thickness and provides the potential of improving both brightness and uniformity of the screen pattern.

DESCRIPTION OF THE PREFERRED EMBODIMENTS

For a better understanding of the present invention, together with other and further objects, advantages and capabilities thereof, reference is made to the following specification and appended claims in connection with the aforedescribed drawings.

Figure 1:
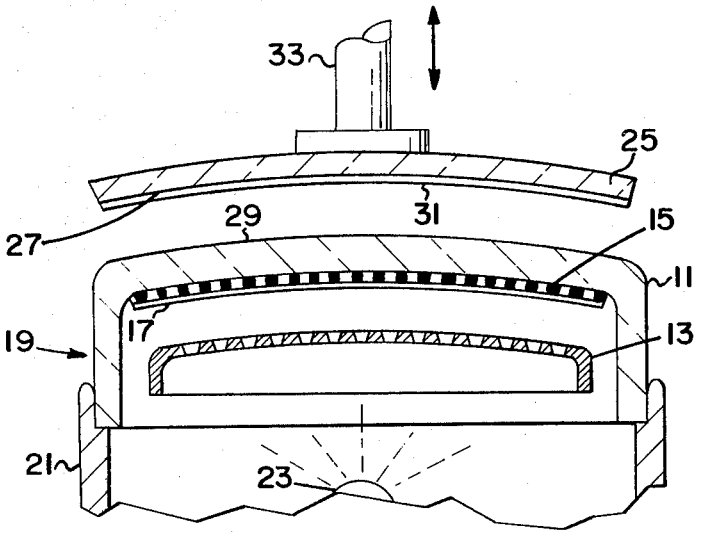
FIG. 1 is a cross-sectional view showing the mask-panel assembly positioned on the exposure apparatus.

With reference to the drawings, there is illustrated in FIG. 1 a face panel 11 of a color cathode ray tube having an apertured mask 13 spatially positioned therein by means not shown. An opaquely defined windowed-webbing 15 has been priorly disposed on the interior surface of the viewing area of the face panel 11, in accordance with the apertures of the mask 13, by techniques known in the art. The windowed-webbing 15 on the face panel has a coating 17, of an energy sensitive polymerizable material and an associated phosphor, disposed thereover in preparation to the formation of one set of pattern elements comprising the patterned screen structure. As shown, the mask-panel assembly 19 is positioned on an optical exposure apparatus 21 accommodating therein a specifically oriented radiant energy or light source 23 from which emanates energy that is beamed through the apertures in the mask to effect discrete exposure of the screen pattern on the respective window areas of the panel. Positioned above the panel 11 is a substrate member 25 of which the surface 27 proximal to the panel is shaped in a manner to be compatible with the exterior contour 29 of the panel. Suitably disposed on the proximal surface 27 is a reflective medium 31 or mirror-like substance that exhibits a high incidence of radiant energy reflectance in substantially the 340 to 380 nanometer range. This type of mirror-like coating 31 is preferentially continuous and may be formed of metallic depositions of representative materials such as aluminum, silver, and rhenium.

Substrate movement means 33 is shown to enable positioning of the reflective medium against the exterior surface of the panel 11 prior to exposure and removal therefrom after exposure; such movement being necessitated to facilitate handling of the panel relative to the exposure apparatus 21. While, as shown, the substrate movement means is indicated to have vertical movement, such is not limited thereto as angular movement in the form of a side oriented hinge effect may also be appropriate in certain situations. The portrayal as illustrated in FIG. 1, shows the coating 17 disposed over the windowed-webbing on the panel in readiness for effecting the initial pattern elements of the screen structure. The reflective medium 27 is about to be lowered to make contact with the exterior surface 29 of the panel in preparation for the forthcoming exposure step.

Figure 2:
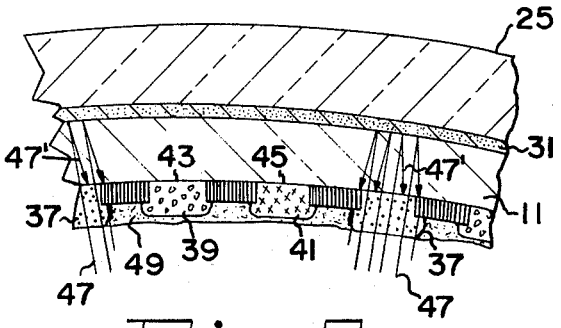
FIG. 2 is a sectional enlargement illustrating a portion of the panel and related reflective medium.
Figure 3:
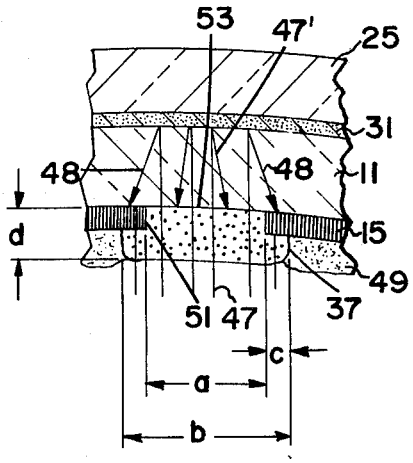
FIG. 3 is a further enlargement showing one phosphor element in relationship with an associated window of the webbing and the related reflective medium.

With reference to FIGS. 2 and 3, an enlarged portion of the panel 11 and the contiguous reflective medium 31 are shown whereof exposure of the third pattern elements 37 of the screen structure is being consummated. The first and second screen pattern elements 39 and 41 respectively, have been priorly disposed relative to their respective window areas, 43 and 45 and illustrate elements of differing and substantially optimized screen thickness and weights. The third pattern areas 37 are receiving beamlets of radiant energy 47 that have traversed the mask apertures, not shown, to effect desired polymerization of the third pattern elements. Areal impingement of the third pattern coating 49 by the directed exposure energy 47 initiates primary-ray polymerization of discrete coating areas or elements 37 that are superimposed on defined window areas 51 of the webbing 15. A portion of the primary radiation 47 traverses the phosphor and associated coating, and the panel glass therebeneath, and impinges the reflective medium 31 thereby producing reflected secondary radiation 47, of a value of about 2 percent of the primary radiation, which re-traverses the glass panel, passing back through the respective windows, to effect augmented secondary-ray polymerization of substantially the obverse region of the interfacially related coating in the defined window areas.

With particular reference to FIG. 3, a further enlargement of a third pattern element 37, such as a dot formation, is shown. The presence of the opaquely defined windows 51 of the screen structure are of utmost importance as they control the useful secondary light 47' reflected from the reflective medium 31 so that it is utilized only in the window areas 51. This reflected secondary energy has diffuse qualities since the rays traversing the glass panel are subject to refractance, reflectance, and diffusion within the panel. The spurious reflections 48 are absorbed by the opaque webbing 15. Since the reflected secondary energy accelerates or effects the rapidity of polymerization of the phosphor related coating of the interfacial region 53 in the window areas, adherence of the pattern element to the surface of the panel is enhanced even though the period of exposure time may, in some instances, be lessened. Thus, the use of reflective lighting facilitates additional control of exposure, thereby better enabling closer optimization of element thickness while beneficially limiting the lateral polymerization growth of the element 37 beyond the periphery of the window 51. In FIG. 3, the areal size of the window is dimensioned as *a*. The circumferential growth or polymerization of the dot 37 beyond the periphery of the window, effected substantially by the primary radiation 47 from a source not shown, is referenced as *c*, the overall lateral dimensioning being indicated by *b*.

For a known phosphor material having a determined degree of attenuation for exposure radiation, a period of exposure time can be judiciously selected to beneficially utilize the advantages of the reflected radiation resultant of the invention. In so doing, the screen thickness *d* can be dimensioned to provide a screen weight that better utilizes the luminous efficiency of the respective phosphor material.

Figure 4:
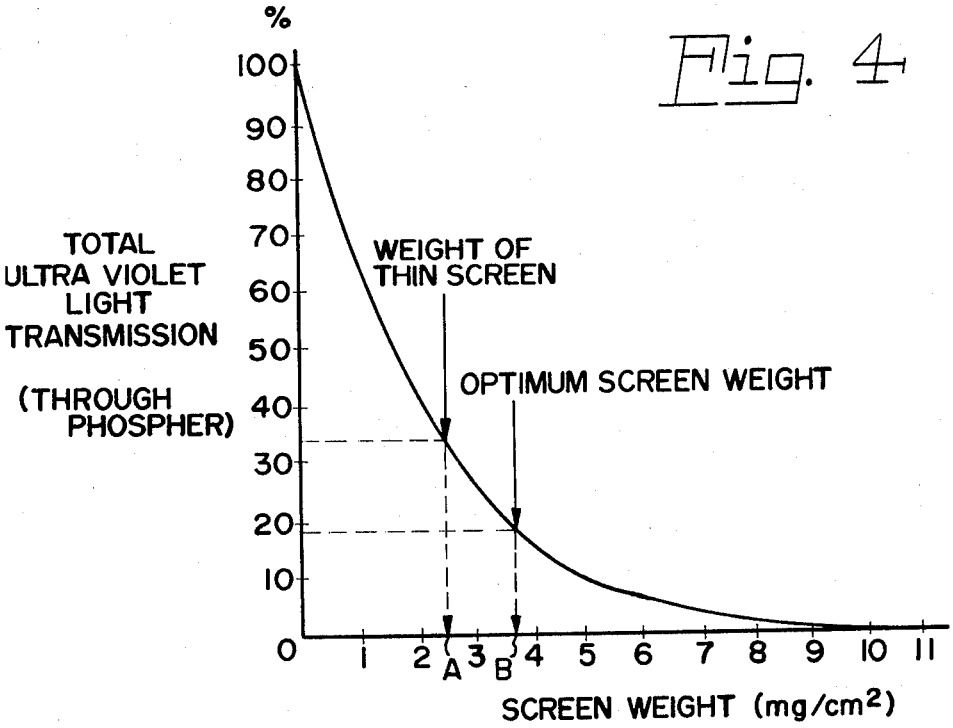
FIG. 4 is a graphic comparison of ultraviolet light transmission versus screen weight.

Reference is directed to the graphical presentation of FIG. 4, which represents an exemplary cathodoluminescent phosphor whereof the amount of light transmission therethrough is related to the resultant screen thickness expressed as screen weight (mg/cm$^2$). For example, prior to use of the invention, the exposure necessary to achieve the degree of polymerization to achieve good adherence and still control lateral growth of the dot, produced a relatively thin screen weight in the order of 2.5 mg/cm$^2$ as referenced at "A". By using the reflective exposure radiation of the invention, a thicker screen can be achieved which more efficiently approaches the optimum screen weight of substantially 3.8 mg/cm$^2$ as referenced at "B".

Figure 5:
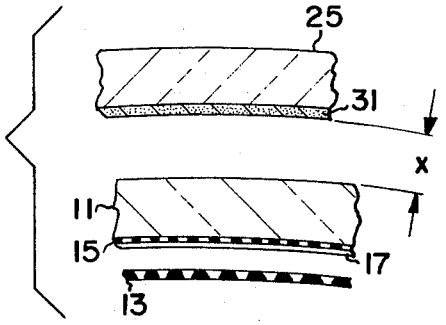
FIG. 5 is a partial sectional view showing a portion of the mask panel assembly and a spatially related reflective medium.

While it is preferred to have the reflective medium 31 in contact with the exterior surface of the panel 11, as shown in FIGS. 2 and 3, there may be occasions when screen pattern exposure is consummated with the reflector removed a slight distance *x* from the panel, such as illustrated in FIG. 5. If such spacing is necessitated by mechanical requirements in automated procedures, the distance *x* should be kept to a minimum to minimize the spacial attenuation of the ultraviolet exposure radiation. It is intended to be in keeping with the concept of the invention to include reflective means oriented in spaced relationship with the exterior surface of the panel 11, whereof the reflective means is of substantially an arcuate contour differing somewhat from that of the panel surface.

Figure 6:
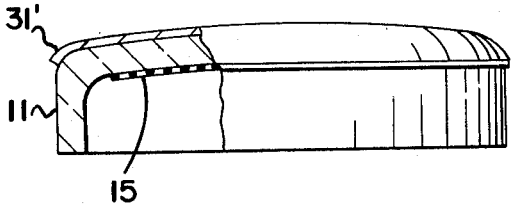
FIG. 6 depicts a partially sectioned panel whereupon another embodiment of the reflective medium is disposed.

Another embodiment of the invention is shown in FIG. 6 wherein the reflective medium 31' is disposed directly upon the exterior surface of the face panel 11. Such deposition may be in the form of reflective coatings applied by suitable means, such as vaporization or spraying, prior to exposure and removal, for example, by solvent means, after exposure.

Still another embodiment of the reflector is in the form of a mirror-like reflective membrane or pliable foil material that is adaptable to be stretched over substantially the viewing area of the panel likened to the reflective medium 31' shown in FIG. 6. Such membrane or pliable material is readily peeled or removed from the panel after the completion of screen exposure.

Thus, there is provided an improvement in the process of forming at least one set of pattern elements comprising a CRT screen structure disposed over a windowed-webbing priorly applied on the face panel. The reflective means of the invention more fully utlies the exposure radiation to effect polymerization of the screen material from both front and back, thereby expediting improved phosphor adherence and achieving a phosphor thickness that is better in keeping with optimum utilization of the luminous efficiency of the phosphor material.

While there has been shown and described what are at present considered the preferred embodiments of the invention, it will be obvious to those skilled in the art that various changes and modifications may be made therein without departing from the scope of the invention as defined by the appended claims.

What is claimed is:

1. An improvement in the exposure process of forming a patterned cathodoluminescent screen of discrete phosphor elements on the viewing area of the face panel of a cathode ray tube in overlay relationship to an opaquely defined windowed webbing priorly disposed thereon, in accordance with an apertured mask spatially positioned within the panel, whereof exposure energy beamed through the mask impinges and polymerizes selected areas of a phosphor related energy-sensitive coating applied over the webbing, said improvement being in the screen exposure process for disposing said phosphor elements comprising:

positioning said coated panel, with said mask oriented therein, on a screen exposure apparatus accommodating a source of exposure radiant energy;

placing a reflective medium relative to the exterior surface of said panel, said medium being of a shaping compatible with the exterior contour of said panel; and beaming said exposure energy through said aperture mask to initiate primary ray polymerization of discrete coating areas superimposed on defined window-areas of said webbing, a portion of said primary radiation upon traversing said coating and said panel therebeneath impinges said reflective medium to produce reflected secondary radiation which retraverses the panel effecting augmented secondary ray polymerization of substantially the obverse region of the interfacially related coating in the window areas.

2. The process improvement of forming a patterned cathode ray tube screen according to claim 1 wherein said reflective medium is disposed on the supportive surface of a support member, said medium supportive surface being of a shaping compatible with the exterior contour of said panel, said support member being formed for placement substantially on and removal from the exterior surface of said panel.

3. The process improvement of forming a patterned cathode ray tube screen according to claim 2 wherein the contour of the reflective supportive surface substantially matches that of the exterior surface of said panel.

4. The process improvement of forming a patterned cathode ray tube screen according to claim 1 wherein said reflective medium is applied in a manner to be contiguous to the exterior surface of said panel, and whereof said reflective medium is removed from said panel after screen formation is accomplished.

5. The process improvement of forming a patterned cathode ray tube screen according to claim 1 wherein said reflective medium is a coating material selected from the group consisting essentially of aluminum, silver and rhenium.

6. The process improvement of forming a patterned cathode ray tube screen according to claim 1 wherein said reflective medium is utilized in the forming of at least one set of pattern areas of said patterned screen.

7. The process improvement of forming a patterned cathode ray tube screen according to claim 1 wherein said reflective medium is oriented in spaced relationship with the exterior surface of said panel.

8. The process improvement of forming a patterned cathode ray tube screen according to claim 7 wherein said reflective medium is of substantially an arcuate contour differing from the exterior contour of said panel.

* * * * *